US006668436B2

(12) United States Patent
Noelle et al.

(10) Patent No.: US 6,668,436 B2
(45) Date of Patent: Dec. 30, 2003

(54) DEVICE FOR TREATING SHEET-LIKE MATERIAL USING PRESSURIZED WATER JETS

(75) Inventors: Frédéric Noelle, Saint Nazaire les Eymes (FR); Bruno Roche, Voglans (FR)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 10/172,876

(22) Filed: Jun. 17, 2002

(65) Prior Publication Data

US 2002/0179744 A1 Dec. 5, 2002

Related U.S. Application Data

(63) Continuation of application No. PCT/FR00/03187, filed on Nov. 16, 2000.

(30) Foreign Application Priority Data

Dec. 17, 1996 (FR) ..... 99.15946

(51) Int. Cl.[7] ..... D06B 1/03
(52) U.S. Cl. ..... 28/167; 28/104
(58) Field of Search ..... 239/548, 556, 239/557, 602, DIG. 19; 28/104, 105, 106, 167, 271, 273, 274; 68/201, 205 R; 264/557, 570

(56) References Cited

U.S. PATENT DOCUMENTS

| | | | | |
|---|---|---|---|---|
| 3,214,819 A | | 11/1965 | Guerin | 28/72.2 |
| 3,485,706 A | | 12/1969 | Evans | 161/72 |
| 3,508,308 A | | 4/1970 | Bunting et al. | 28/72.2 |
| 3,613,999 A | * | 10/1971 | Bentley et al. | 239/553.3 |
| 4,085,485 A | * | 4/1978 | Brandon et al. | 28/104 |
| 5,033,681 A | * | 7/1991 | Munoz | 239/DIG. 19 |
| 5,054,349 A | | 10/1991 | Vuillaume | 83/177 |
| 5,199,640 A | * | 4/1993 | Ursic | 239/602 |
| 5,620,142 A | | 4/1997 | Elkas | 239/596 |
| 5,727,292 A | * | 3/1998 | Vuillaume | 28/104 |
| 5,730,358 A | * | 3/1998 | Raghavan et al. | 239/602 |
| 5,778,501 A | * | 7/1998 | You | 28/104 |
| 5,860,602 A | * | 1/1999 | Tilton | 239/548 |
| 5,908,349 A | | 6/1999 | Warehime | 451/102 |
| 5,933,931 A | * | 8/1999 | Greenway | 28/167 |
| 6,343,410 B2 | * | 2/2002 | Greenway et al. | 28/104 |

FOREIGN PATENT DOCUMENTS

| | | | |
|---|---|---|---|
| DE | 198 49 814 A1 | 10/1998 | B05B/1/02 |
| EP | 0 119 338 A1 | 9/1983 | B26F/3/00 |

* cited by examiner

*Primary Examiner*—Amy B. Vanatta
(74) *Attorney, Agent, or Firm*—Heslin Rothenberg Farley & Mesiti P.C.; John Pietrangelo

(57) ABSTRACT

A device for treating sheet-like material using water jets/needles. The device comprises a pressurize water supply body consisting of a feed chamber extending along the entire length of the body and inside which pressurized water is guided through a filter, and a distribution area distributing pressurized water along the entire length of treatment. The distribution area includes a plate (7) which is provided with microperforations, whereby the holes thereof define water needles which are directed against the surface of the material which is to be treated. The invention is characterized in that the microperforations (15) are provided inside inserts (13) which are made of a hard material. The inserts are set inside pre-made hoes (12) in the plate.

12 Claims, 2 Drawing Sheets

DEVICE FOR TREATING SHEET-LIKE MATERIAL USING PRESSURIZED WATER JETS

CROSS REFERENCE TO RELATED APPLICATIONS

This application is a continuation of PCT application PCT/FR00/03187 filed on Nov. 16, 2000, and published in French as PCT WO 01/44553. PCT/FR00/03187 claimed priority from French application FR 99.15946 filed on Dec. 17, 1999. The entire disclosures of these applications are incorporated by reference herein.

TECHNICAL FIELD

The present invention relates to an improvement made to plants used for treating sheet materials using pressurized water jets, which act on the substance in the manner of needles, and which are used in particular for treating nonwoven structures for the purpose of giving them cohesion and/or modifying their appearance.

Such a technique, which has been used for decades, as is apparent for example from patents U.S. Pat. Nos. 3,214,819 and 3,485,706, consists in subjecting the sheet structure to the action of water jets coming from one or more successive injector rails, the sheet or web being supported by a porous or perforated conveyor belt or rotating roll, subjected to a suction source allowing the water to be recovered.

One of the essential elements of such plants is the system for forming the water jets or needles, commonly referred to by the term "injector".

The invention relates more particularly to a novel type of perforated plate comprising such injectors and which are one of the essential elements for forming water jets or needles.

PRIOR ART

The injectors used at the present time have a general structure as illustrated in FIG. 9 of patent U.S. Pat. No. 3,508,308 and U.S. Pat. No. 3,613,999.

More recently, EP 400249 (corresponding to U.S. Pat. No. 5,054,349) proposed an improved injector which not only makes it possible to inject water at a very high pressure (greater than 100 bar) but has a structure such that it allows the perforated plate, through which the microjets pass, to be easily fitted and removed, for example for the purpose of cleaning.

The appended FIG. 1 illustrates, in a general way, the structure of an injector.

Referring to this figure, such an assembly is therefore in the form of a continuous injector rail which extends transversely with respect to the direction of movement of the sheet material (F) to be treated, for example a nonwoven, and the length of which is matched to the width of said material.

This injector rail consists of a main body (1) which can withstand any deformation due to the water pressure, and in the upper part of which there is a chamber (2), in general of cylindrical shape, fed with pressurized water by a pump (not shown) through pipework (3).

Placed inside the chamber (2) is a cartridge (4) consisting, for example, of a perforated cylinder lined with a filter cloth, which not only acts as a filter, but also as a distributor.

The pressurized water introduced inside the chamber (2) then flows through cylindrical holes (5), which are separated with a regular pitch over the entire width of the injector, the diameter of which holes is in general between 4 mm and 10 mm, the thickness of the wall between two consecutive holes being about 3 to 5 mm.

These cylindrical holes (5), the outlet end of which may possibly be of conical shape, then emerge in a lower chamber (6) at the base of which a plate (7) provided with microperforations is positioned, the diameter of which may be between 50 and 500 $\mu$m and preferably between 100 and 200 $\mu$m, enabling water jets or needles (8) to be formed which act directly against the surface of the material (F) to be treated, for example a nonwoven web.

The perforated plate (7) is held against the main body of the injector, according to the teachings of EP 400249, for example, by longitudinal jaws (9) subjected to the action of hydraulic cylinders which allow a clamping action to be exerted by means of a system of cross bars and pull rods placed along the injector.

A seal (not shown) is placed between the perforated plate (7) and the base of the main body (1).

At present, the perforated plates (7) which enable the jets to be produced are all made by drilling or punching thin strips of stainless steel.

These strips have a thickness of between 0.6 and 1.2 mm.

FIG. 2 is a sectional view of a perforated plate used at present.

In such plates, the capillaries (10) enabling jets to be formed are, as mentioned above, obtained by drilling or punching and have a general shape such that they comprise, if the direction of movement of the jets is followed, a cylindrical inlet region (11) extended by a divergent wall.

While such plates are satisfactory when the pressure of water in the injector is less than 200 bar, they do not however operate industrially at pressures which are higher so as to obtain a high fluid velocity which could reach 300 m/sec.

This is because it has been noticed that the mean life of such perforated plates made of stainless steel does not exceed 24 hours when working at pressures of 400 bar.

Moreover, the drilling and punching techniques used to produce the capillaries do not allow a perfect surface condition of the inner wall to be obtained or a sharp edge to be produced at the inlet of each capillary in an accurate and regular way which, at high fluid velocities, leads to a deterioration in the quality of the jets by the formation of turbulence in the flow.

SUMMARY OF THE INVENTION

A novel type of perforated plate has now been found and it is this which forms the subject of the present invention, which makes it possible to solve the aforementioned problems and allows water to be supplied at high pressure, which could reach 400 bar or more, without damaging said plate after a period of use which could reach several hundred hours.

Moreover, the novel type of plate according to the invention makes it possible to obtain jets having a high velocity which can reach 300 m/sec or even more, with very high homogeneity and regularity over the entire length of the plate.

In addition, it has been noted that, compared to the prior art, the jets obtained with the plate according to the invention remain coherent over a greater length.

In general, the invention therefore relates to a device called an "injector" allowing sheet material (nonwoven, textile complex, film, paper, etc.) to be treated by means of water jets/needles, which comprises:

a body for supplying pressurized water, comprising a feed chamber extending over the entire length of said body, and inside which the pressurized water is taken through a filter;

a distribution region, distributing the pressurized water over the entire treatment width, comprising a plate fitted with microperforations, the holes of which define water needles directed against the surface of the material to be treated, and it is characterized in that microperforations or capillaries are produced inside inserts made of hard materials of the type comprising zirconia, ruby, sapphire, ceramic and other materials of equivalent hardness, set inside holes previously made over the entire thickness of the plate.

According to one embodiment, the inserts preferably have a thickness less then the depth of the holes made in the plate.

Moreover, although said inserts can be placed in a single row over the entire length of the plate, it is possible to place them in two parallel rows, the capillaries or microperforations being offset with respect to each other from one row to the next.

The capillary or microperforation of each insert comprises a cylindrical inlet region, the diameter of which is between 50 and 500 μm and preferably between 100 and 200 μm as for the microperforations of the prior art plates. This cylindrical part may be extended by a divergent region in the form of a dome or a cone or by a sudden widening obtained by means of an outlet region of greater diameter than the inlet region.

Advantageously, the thickness of the plate will be between 1 and 3 mm, the machined holes inside which the insert are set having, themselves, a diameter between 0.5 and 2 mm.

The lower face of the inserts may be located recessed with respect to the lower face of the plate.

Using such a design for the perforated plate, it is possible to generate jets which are equivalent in number and in diameter to those of the plates belonging to the prior art with the advantage of forming each jet in a nozzle whose geometry, surface condition and hardness are exceptional.

Apart from an increased life, these new perforated plates with inserts made of zirconia, sapphire, ruby or other materials of equivalent hardness, such as ceramic, allow operation at high pressures, while having very good regularity of jets with an increased life for the plates and moreover, and surprisingly, such plates lead to an improvement in the strength of the products obtained, when treating nonwovens.

BRIEF DESCRIPTION OF THE DRAWINGS

The invention and the advantages provided thereby will however be better understood using the nonlimiting exemplary embodiments given below by way of example, which are illustrated by the appended diagrams in which.

as indicated above.

MANNER OF REALIZING THE INVENTION

Figure 3:
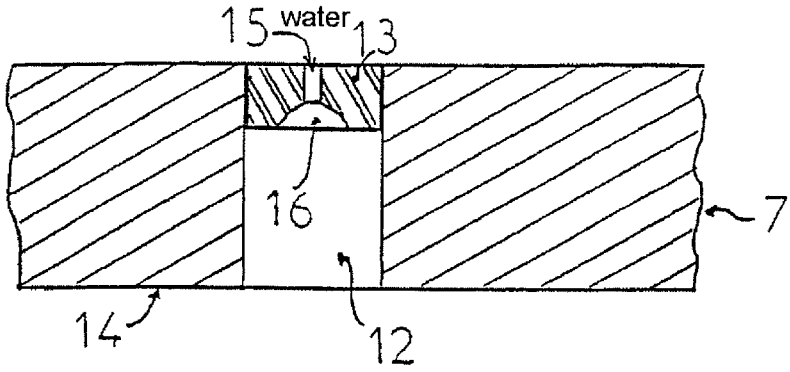
FIG. 3 illustrates in section, considerably enlarged, the structure of a perforated plate produced according to the invention.

With reference to appended FIG. 3, the microperforated plate according to the invention therefore consists, as in the prior plates (7), of a stainless steel strip having a thickness of between 1 and 3 mm, and in which holes (12) of cylindrical cross section have been machined.

To produce the microjets, inserts (13) made of zirconia, sapphire, ruby or other materials of equivalent hardness are set inside each hole (12).

Such inserts (13) have an external diameter equivalent to the diameter of the holes (12) and which is therefore between 0.5 and 2 mm.

In this embodiment, the thickness of the inserts is less than the thickness of the plate (7) so that they are located recessed with respect to the lower face (14) of the plate when side inserts (13) have been fitted.

Each insert comprises, in its thickness, a capillary or microperforation (15) having a diameter between 100 and 200 μm extended at its base by a divergent region (16) in the form of a dome or cone.

The presence of such divergent regions (16), together with the fact that the inserts (13) are recessed with respect to the lower face (14) of the plate (7), mean that the capillary (15) therefore opens out into the space inside each hole (12).

Surprisingly, a structure of this sort has the consequence of leading to improved jet formation.

Figure 2:
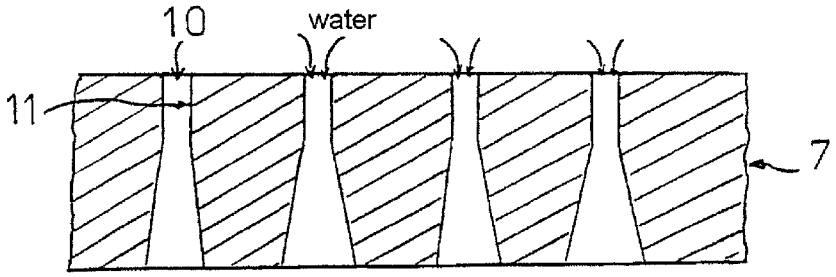

To illustrate the advantages provided by the invention, comparative tests were carried out on a machine of the "Jetlace 2000" type of the applicant, equipped with injectors made according to the prior art as illustrated in FIG. 2, and with injectors equipped with a perforated plate (7) made according to the invention for a second series of tests carried out under the same water-pressure conditions.

Figure 1:
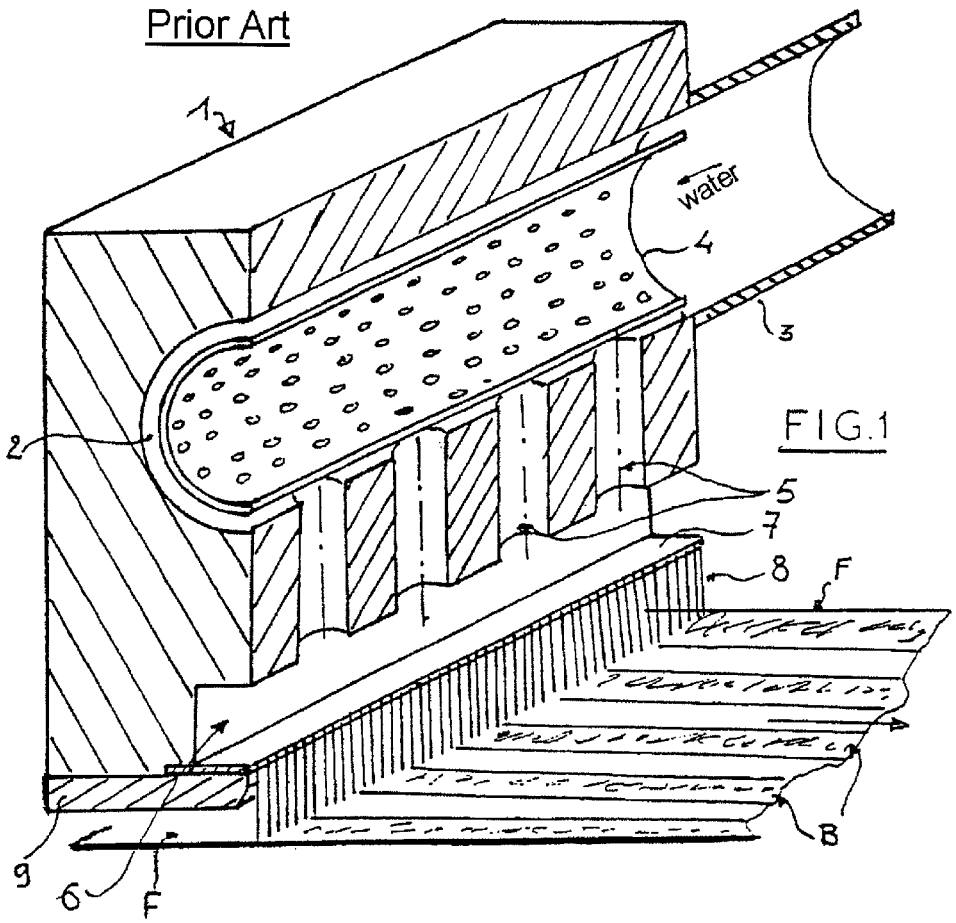
FIG. 1 illustrates schematically a sectional view along its vertical plane of symmetry of the structure of an injector according to the invention, FIG. 2 itself illustrating, also in section, the structure of the microperforated plates used in such injectors according to the prior art.

In these comparative tests, the injectors which have a structure as illustrated in FIG. 1 have the following characteristics:

| | |
|---|---|
| diameter of the upper chamber (4): | 50 mm |
| diameter of the duct (5): | 6 mm |
| interaxis distance between two consecutive ducts (5): | 10 mm |
| height of the duct (5) | 35 mm |
| height of the lower chamber (6): | 10 mm |

In the first series of tests (tests No. 1), the micro perforated plate made according to the prior art comprises two rows of 120 μm microperforations separated from each other by 1.2 mm in each row and being offset from one row to the next, each row comprising 833 microperforations therefore leading to a plate which comprises 1666 microperforations per meter.

The thickness of the stainless steel strip from which the plate is made is 1 mm.

The other series of tests (tests No. 2) is carried out on plates according to the invention made from a strip, also made of stainless steel, but having a thickness of 2 mm.

In such a plate the microperforations are made in the inserts (13) set in the holes (12) having a diameter of 0.7 mm.

Each insert (13) has a thickness of 0.2 mm and comprises, in the central part, a capillary (15) also having a diameter of 120 μm extended by a divergent region (16).

These inserts are made of zirconia and are placed, as the microperforated plate produced according to the prior art, in two rows, each row also comprising 833 holes, each one having a diameter of 120 $\mu$m and separated by 1.2 mm in each row, therefore leading to a plate which also comprises 1666 holes per meter.

In the following two specific examples, test No. 1 is carried out on a conventional perforated plate, and test No. 2 on a perforated plate with zirconia inserts according to the invention.

EXAMPLE 1

Under the aforementioned conditions, a nonwoven based on 1.7 dtex/40 mm viscose fibers weighing 150 g/m$^2$, was treated.

The treatment conditions and the properties of the product obtained will become apparent from the table below.

| | Pressure (bar) | Strength, machine direction (N/50 mm) | Strength, cross direction (N/50 mm) |
|---|---|---|---|
| TEST 1 | 200 | 319 | 87 |
| TEST 2 | 200 | 367 | 100 |

EXAMPLE 2

A second series of tests was carried out, but on a nonwoven based on 1.7 dtex/38 mm polyester fibers, weighing 330 g/m$^2$.

The treatment conditions (pressure) and properties of the products obtained are brought together in the table below.

| | Pressure (bar) | Strength, machine direction (N/50 mm) | Strength, cross direction (N/50 mm) |
|---|---|---|---|
| TEST 1 | 350 | 659 | 1670 |
| TEST 2 | 350 | 720 | 1837 |

It was found that, in the two series of comparative tests, an improved strength was obtained for the treated product, and this both in the machine direction and in the cross direction, with the plates produced according to the invention.

Moreover, during use, it was noticed that the plates made according to the invention lasted much better than the prior art plates.

Furthermore, it was noticed that the product obtained from example 1 and which therefore had a viscose fiber base, had a much more uniform surface condition after treatment within the scope of a treatment according to the invention, while jet traces appeared on the product produced from a conventional plate.

Figure 4:
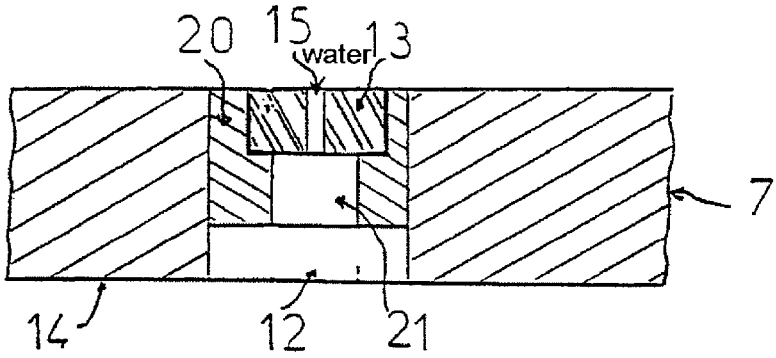
FIGS. 4 and 5 illustrate two embodiments of inserts which can be used to obtain a perforated plate according to the invention.
Figure 5:
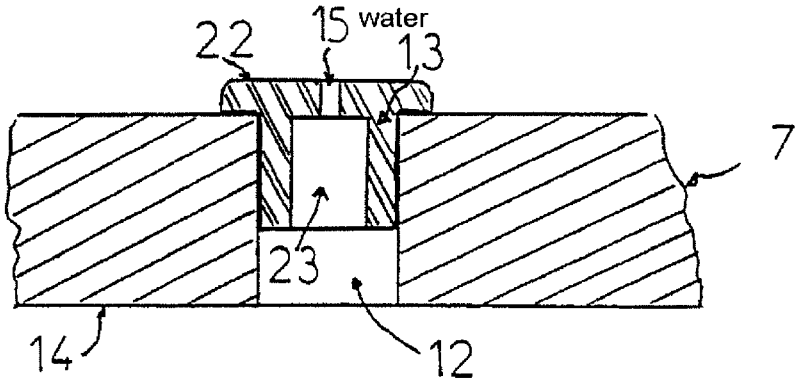

FIGS. 4 and 5 illustrate two embodiments which enable an insert (13), which could be damaged during use, to be more easily replaced and which also show variants in the shape of the capillaries.

Thus in the embodiment illustrated in FIG. 4, the insert (13) is mounted, not directly inside the duct (12), but via an intermediate support (20), set into the duct (12) which therefore has a diameter greater than that illustrated in FIG. 3.

This support has a hardness less than that of the insert (13) and may be made of stainless steel.

In this embodiment, the capillary (15) is cylindrical over its entire length and opens out into a duct (21) of greater diameter leading to a sudden broadening.

In the variant illustrated n FIG. 5, the insert (13), also made of zirconia, comprises on its upper part a rim (22) which bears on the upper face of the plate (7).

The capillary also consists of a cylindrical duct (15) extended by a region (23) of larger diameter, also causing a sudden broadening.

Such a design may facilitate the removal of an insert for the purpose of its replacement.

Finally, while in the examples illustrated the inserts are placed recessed with respect to the lower face of the plate, it could be envisioned that they come level therewith.

Of course, the invention is not limited to the exemplary embodiments described above, but it covers all the variants thereof made in the same spirit.

What is claimed is:

1. A method for treating sheet material, the method comprising:

providing a plate having a first hardness, the plate having a plurality of holes;

providing a plurality of inserts, the inserts comprising a material having a second hardness, greater than the first hardness, and each insert having a microperforation;

inserting the plurality of inserts in the plurality of holes;

exposing the microperforations to pressurized water wherein the microperforations provide a plurality of water jets; and impinging the plurality of water jets upon the sheet material to provide at least one of cohesion and appearance modification to the sheet material;

wherein the resulting sheet material comprises a sheet material having improved strength compared with sheet material treated in a similar manner but without providing the plurality of inserts.

2. The method as recited in claim 1, wherein the resulting sheet material comprises a sheet material having improved strength in one of the machine direction and cross machine direction compared with sheet material treated in a similar manner but without providing the plurality of inserts.

3. The method as recited in claim 1, wherein the resulting sheet material comprises a sheet material having at least about a 10% increase in strength compared with sheet material treated in a similar manner but without providing the plurality of inserts.

4. The method as recited in claim 3, wherein the resulting sheet material comprises a sheet material having at least about a 15% increase in strength compared with sheet material treated in a similar manner but without providing the plurality of inserts.

5. The method as recited in claim 1, wherein the resulting sheet material comprises a sheet material having at least about a 10% increase in strength in one of the machine direction and cross machine direction compared with sheet material treated in a similar manner but without providing the plurality of inserts.

6. The method as recited in claim 1, wherein the plurality of inserts comprise one of zirconia, ruby, sapphire, and ceramic.

7. The method as recited in claim 1, wherein the plurality of holes have a depth, and wherein providing a plurality of inserts comprises providing a plurality of inserts having a thickness less than the depth of the plurality of holes.

8. The method as recited in claim 1, wherein providing the plurality inserts having microperforations comprises providing a plurality of inserts having microperforations having a cylindrical inlet region and a divergent region.

9. The method as recited in claim 1, wherein providing a plate having a plurality of holes comprises providing a plate having a plurality of circular holes having diameters between 0.5 and 2mm, and providing a plurality of inserts comprises providing a plurality of inserts comprising microperforations having diameters of between 50 and 500 um.

10. The method as recited in claim 1, further comprising providing a plurality intermediate supports in the plurality of holes, and wherein inserting the plurality of inserts comprises mounting the plurality of inserts on the plurality of intermediate supports.

11. The method as recited in claim 1, wherein providing a plurality of inserts having microperforations comprises providing a plurality of inserts having microperforation having diameters between about 50 um and about 500 um.

12. The method as recited in claim 1, wherein providing a plurality of inserts having microperforations comprises providing a plurality of inserts having microperforations comprising capillaries.

* * * * *

UNITED STATES PATENT AND TRADEMARK OFFICE

CERTIFICATE OF CORRECTION

PATENT NO. : 6,668,436 B2
DATED : December 30, 2003
INVENTOR(S) : Noelle et al.

It is certified that error appears in the above-identified patent and that said Letters Patent is hereby corrected as shown below:

Title page,
Item [57], ABSTRACT,
Line 13, delete the word “hoes” and insert the word -- holes --.

Column 8,
Line 6, delete the word “microperforation” and insert the word -- microperforations --.

Signed and Sealed this

Twenty-third Day of March, 2004

JON W. DUDAS
*Acting Director of the United States Patent and Trademark Office*